United States Patent [19]

Hara

[11] Patent Number: 4,804,952

[45] Date of Patent: Feb. 14, 1989

[54] DISPLAY DEVICE INTERFACE CIRCUIT

[75] Inventor: Masashi Hara, Nara, Japan

[73] Assignee: Sharp Kabushiki Kaisha, Osaka, Japan

[21] Appl. No.: 900,685

[22] Filed: Aug. 27, 1986

[30] Foreign Application Priority Data

Aug. 29, 1985 [JP] Japan ..... 60-191687

[51] Int. Cl.[4] ..... G09G 1/16

[52] U.S. Cl. ..... 340/730; 340/734

[58] Field of Search ..... 340/734, 730

[56] References Cited

U.S. PATENT DOCUMENTS 3,984,828 10/1976 Beyers, Jr. ..... 340/730
4,352,100 9/1982 O'Connell ..... 340/734
4,437,092 3/1984 Dean et al. ..... 340/730
4,651,175 3/1987 Tozaki ..... 340/730

FOREIGN PATENT DOCUMENTS

3417187A1 11/1984 Fed. Rep. of Germany .

*Primary Examiner*—Howard A. Birmiel
*Attorney, Agent, or Firm*—Birch, Stewart, Kolasch & Birch

[57] ABSTRACT

A display device interface circuit comprises a primary skew circuit for skewing a video signal for a predetermined period converted to a serial signal; a secondary skew circuit for skewing a blank signal which determines the flyback time for a predetermined period; and a logic circuit for adding signal outputs of the secondary skew circuit to the head and tail of the video signal skewed by the primary skew circuit for a predetermined period.

8 Claims, 6 Drawing Sheets

DISPLAY DEVICE INTERFACE CIRCUIT

BACKGROUND OF THE INVENTION

The present invention relates to an interface circuit for a display device such as a CRT (Cathode Ray Tube), or more particularly to an interface circuit capable of minimizing the video RAM dead area to display as much data as possible at a time without changing the video RAM capacity.

In the reverse display on a CRT, characters displayed closest to the screen edge are illegible because they overlap "margin a" surrounding the CRT screen as shown in FIG. 7.

The conventional solution to this problem is to set dead area b where no character is displayed in the vicinity of the "margin a" (see FIG. 8). The dead area b setting has been achieved by programming.

With this conventional display method, however a, smaller video RAM capacity is used for data display than the allocated hardware capacity for data display. In other words, dead area results in the video RAM; the video RAM cannot be used to the maximum capacity to display as much volume of data as possible.

SUMMARY OF THE INVENTION

An object of the present invention is to provide an interface circuit capable of decreasing the video RAM dead area to display as much data as possible without changing the video RAM capacity.

Another object of the present invention is to provide an interface circuit for providing a dot ON area where dots are turned ON by a display panel not by a horizontal video RAM but by hardware construction. Thereby thereby the video RAM dead area is decreased and as much data as possible can be displayed without changing the capacity.

A further object of the invention is to provide an interface circuit for achieving optimum reverse images on a CRT or other display devices.

Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

To achieve the above objects, according to an embodiment of the present invention, a display device interface circuit comprises a primary skew circuit for skewing a video signal converted to a serial signal for a predetermined period, a secondary skew circuit for skewing a blank signal for a predetermined period which determines the flyback time, and a logic circuit for adding signal outputs of the secondary skew circuit to the head and te tail of the video signal skewed by the primary skew circuit for a predetermined period.

In the interface circuit, a video signal is created from a serial signal skewed, say, for one character (a character unit on hardware) by the primary skew circuit, and a blank signal ($\overline{BLANK_2}$) is created by skewing a blank signal ($\overline{BLANK}$) for two characters. On the basis of the skewed video signal and blank signal ($\overline{BLANK_2}$), signals each corresponding to one character are added to the head and the tail of the video signal or serial signal skewed for one character via the logic cicuit, so as to form "margin" with a constant width on the lateral ends of the CRT screen.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 5:
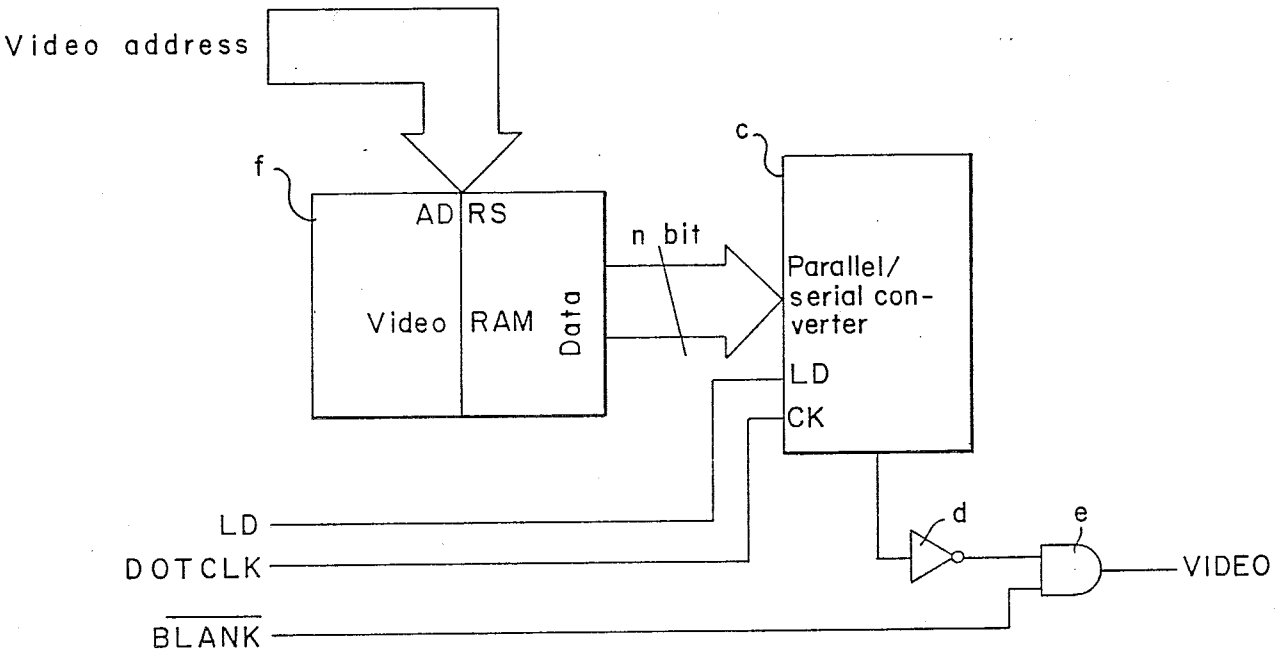
FIG. 5 is a circuit diagram showing a typical CRT interface circuit by a raster scan system.
Figure 6:
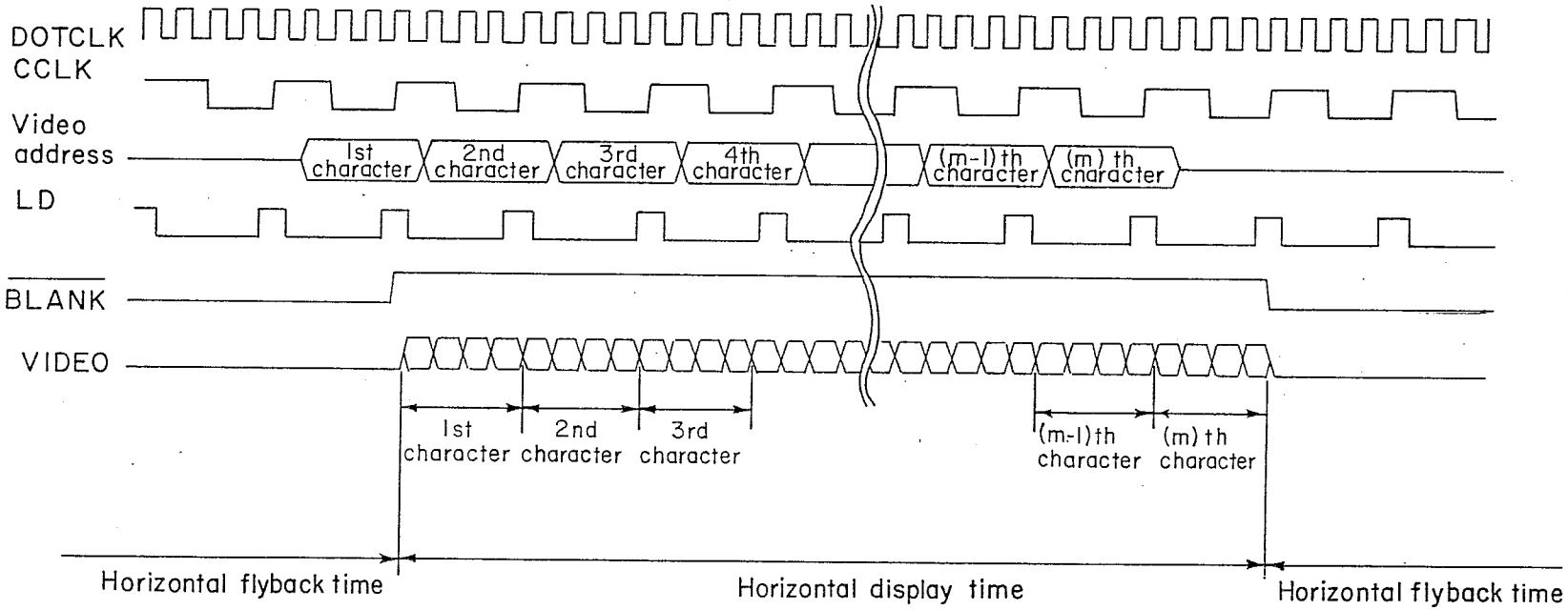
FIG. 6 is a timing chart showing the signal timing in the circuit of FIG. 5.
Figure 7:
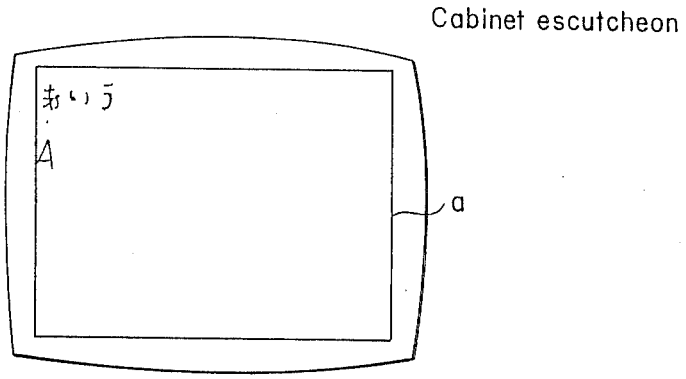
FIGS. 7 and 8 are front views of a CRT screen for explaining the conventional dead area.

Prior to describing an embodiment of an interface circuit of the present invention, the basic conception of the invention is presented using FIGS. 5 and 6.

FIG. 5 shows the general construction of a raster scan type CRT interface circuit. FIG. 6 is a timing chart showing the signal timing in the circuit.

A video address output from the CRT control circuit (not shown) is input to a video RAM f which transmits n-bit parallel video data to a parallel/serial converter c. The parallel video data is not a character font data actually displayed on the CRT but a hardware character unit attributable to the control circuit. As shown in FIG. 6, "m" characters each comprising four dots are horizontally aligned.

The parallel/serial converter c controls its input and output by a load signal (LD) and a dot clock (DOTCLK), respectively. Specifically, the parallel video data is loaded in the parallel/serial converter c at the same timing as the load signal (LD) is input and converted to serial data and the serial data is output at the same timing as the dot clock (DOTCLK) is input. The serial data is then reversed by an inverter d for reverse display and input to one of the two terminals of an AND gate e which causes blanking. To the other terminal of the AND gate e a blank signal ($\overline{BLANK}$) is input which erases the output during the flyback time, so that the reversed serial data is output as a video signal (VIDEO) to the CRT monitor (not shown).

Reverse picture display on the CRT using the circuit shown in FIGS. 5 and 6, however, does not use all the video RAM capacity available by the hardware design (resulting in a large dead area in the video RAM). This may hamper the effective use of the video RAM.

In this description, reverse picture display refers to a display in which only the dots corresponding to display information are turned OFF while all the other dots on the CRT screen are turned ON as a background to visualize the information.

Now, an embodiment of a display device interface circuit of the present invention is described with reference to FIGS. 1 through 4.

Figure 1:
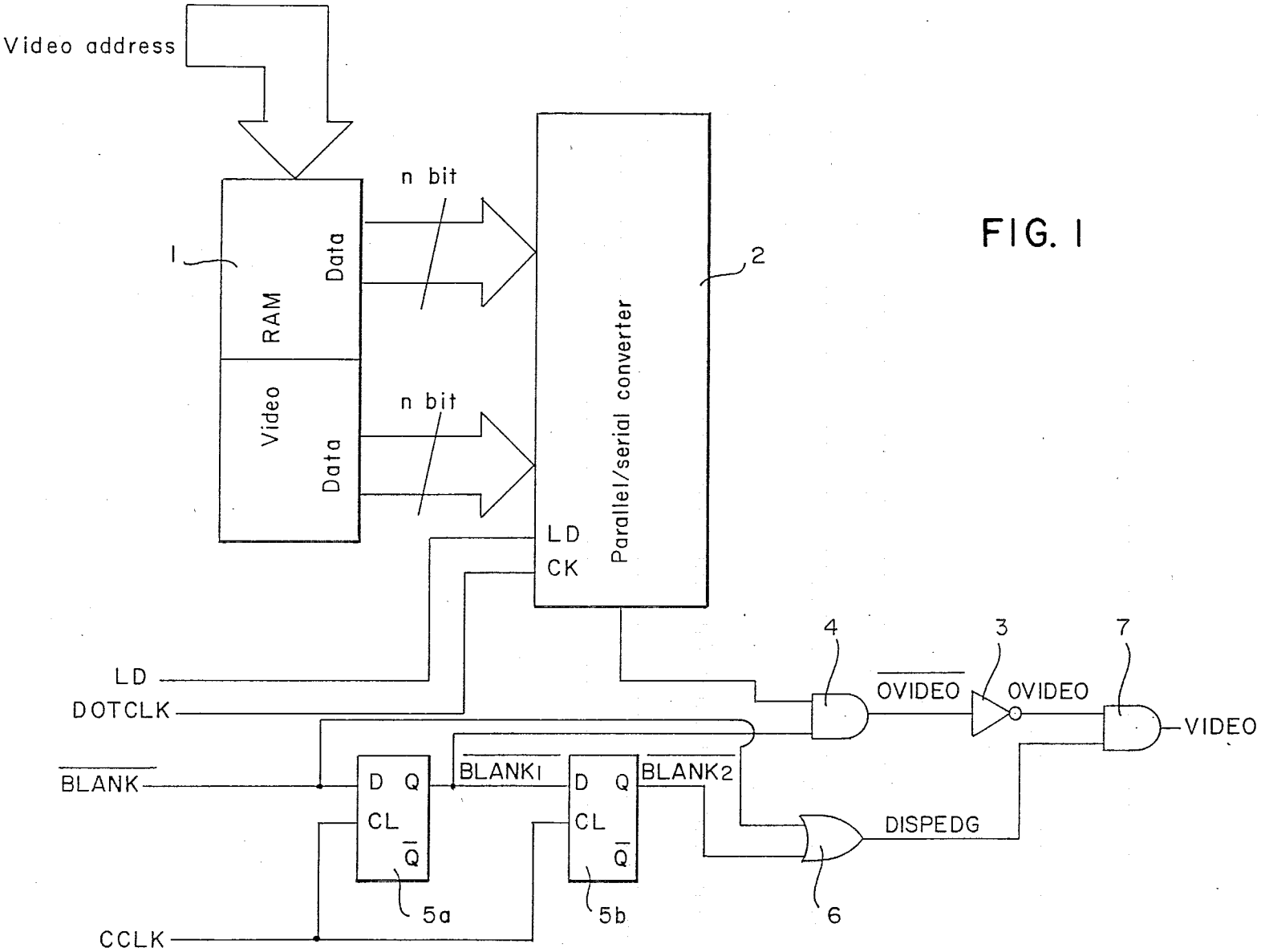
FIG. 1 is a circuit diagram showing an embodiment of a reverse display CRT interface circuit of the present invention.
Figure 2:
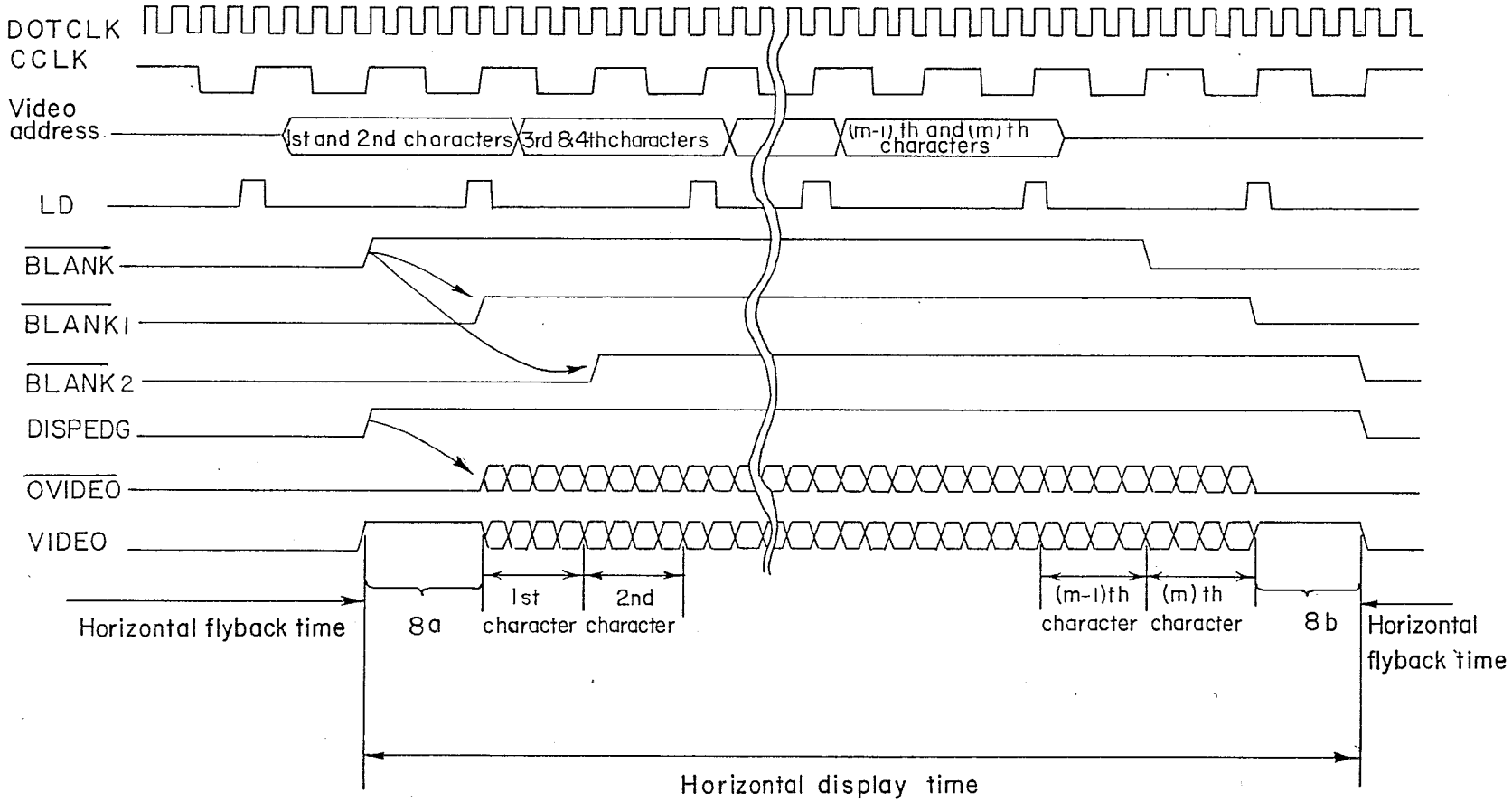
FIG. 2 is a timing chart showing the timing of each signal of the circuit of FIG. 1.

FIG. 1 shows a CRT interface circuit of the present invention and FIG. 2 is a timing chart for explaining the signal timing in the interface circuit. The interface circuit mentioned here is the one designed for reverse picture display.

As mentioned earlier, the term "character" here does not mean a real character actually presented on the screen but a hardware—based character unit attributable to the control circuit.

Referring to FIG. 1, two characters can be read simultaneously in parallel with each other from a video RAM 1. Each character is composed of "n" bits. The two parallel character data are input in a parallel/serial converter 2 with capacity for "2n" bits. (The video RAM is accessed by time sharing between the CRT control circuit (not shown) and the CPU (not shown).) To the parallel/serial converter 2 a load signal (LD) and a dot clock (DOTCLK) are input which cause two "n"-bit parallel data from the video RAM 1 to be converted to serial data and output from the parallel/serial converter alternately. Accordingly, with the video RAM of the present invention, the count speed for the video address from the CRT control circuit (not shown) is only a half of the video RAM from which only one parallel data can be read at a time (Refer to FIGS. 5 and 6). In addition, it is possible to set the circuit so that the parallel/serial converter 2 outputs a serial signal skewed for one character. The serial signal skewed for one character is input to one of the two input terminals of an AND gate 4. To the other terminal of the AND gate a blank signal ($\overline{BLANK_1}$) is input for erasing the input during flyback time. The blank signal ($\overline{BLANK_1}$) has been skewed for one character by a D-flip flop 5*a* which is later described. The AND gate 4 outputs an original video signal ($\overline{OVIDEO}$) which is inverted by an inverter 3 to become a reversed original video signal (OVIDEO). FIG. 2 shows the signal timing for displaying "m" characters horizontally. Since each character comprises "n" dots (n=4 in this embodiment), the OVIDEO signal is a "n×m" dot signal.

Meanwhile, two D-flip flops 5*a* and 5*b* convert the blank signal ($\overline{BLANK}$) to a two-character-skewed signal ($\overline{BLANK_2}$) at timings determined by character clocks (CCLK). The $\overline{BLANK_2}$ signal and $\overline{BLANK}$ signal are passed through an OR gate 6 to take a logical sum of the two signals and output as DISPEDG signal. Therefore, the DISPEDG signal is kept at "H" level throughout the period from one character before the OVIDEO signal to one character after the OVIDEO signal. The OVIDEO signal and the DISPEDG signal are passed through an AND gate 7 to take the logical product and input to a CRT monitor as a video signal (VIDEO). As shown in FIG. 2, the video signal thus produced has additional dot ON area for at least one character 8*a* and 8*b* each at the head and tail of the signal from the video RAM 1. Accordingly, the number of horizontal dots on the CRT monitor must be increased for the additional two characters.

Figure 3:
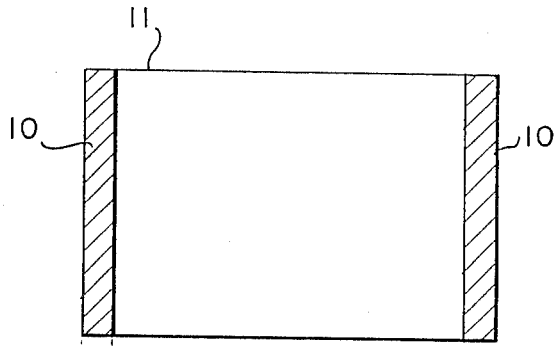
FIG. 3 is a front view of a CRT screen showing the dot ON area.
Figure 4:
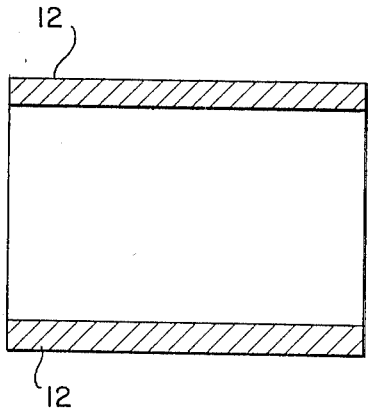
FIG. 4 is a front view of a CRT screen showing the dead area.

FIGS. 3 and 4 illustrate the display area available and the dead area on the CRT screen effected by the CRT interface circuit of the present invention.

Figure 8:
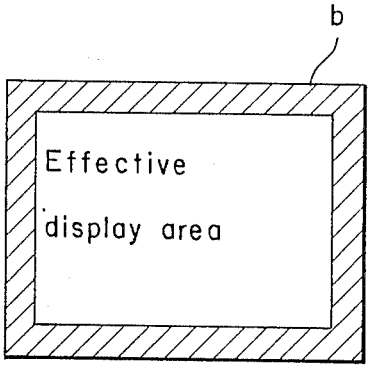

The shaded zones 10 in FIG. 3 indicate the area in which dots are turned ON regardless of the video RAM due to the circuit construction of the present invention. The remaining zone 11 is the display area effected by the video RAM 1. The shaded zones 12 in FIG. 4 indicate the dead area remaining unremoved by the circuit construction of the present invention. Obviously, the dead area in the present invention is smaller than the conventional dead area (indicated by "b" in FIG. 8).

According to the present invention, as described above, the video RAM dead areas is decreased so that a larger volume of information can be presented as a reversed picture on the display without increasing the capacity.

In the above embodiment, the invention is applied to a CRT display, although it may be applied to other display devices such as an EL display and a LCD as well. In addition to the reverse picture display as exemplified above, the interface circuit of the present invention is also applicable to normal picture displays in which the dots corresponding to the display information are turned ON while all the other dots on the display screen are turned OFF as background. The present invention is effective for the display device of a word processor.

While only certain embodiments of the present invention have been described, it will be apparent to those skilled in the art that various changes and modifications may be made therein without departing from the spirit and scope of the present invention as claimed.

What is claimed is:

1. A display interface circuit for modifying a video signal received from a video source and containing predetermined video information to be displayed to enhance a display produced by display means raster scanning said video signal across a display device, by increasing the size of the background displayed thereupon around said predetermined video information, comprising:

means for receiving said video signal from said video source;

means for receiving a blanking signal from said video source for inhibitng said video signal;

first signal skewing means, responsive to a clock pulse generated by said video source and said blanking signal, for delaying said blanking signal to develop a first delayed blanking signal;

second signal skewing means, responsive to said clock pulse and said first delayed blanking signal, for delaying said first delayed blanking signal to develop a second delayed blanking signal;

first logic circuit means, responsive to said first delayed blanking signal, for delaying said video signal by an amount determined by said first delayed blanking signal to produce a background signal;

second logic circuit means for logically summing said first delayed blanking signal and said second delayed blanking signal to produce a background signal;

third logic circuit means for logically ANDing said background signal and said delayed video signal to produce a video output signal; and said video output signal including said predetermined video information and said background signal, the presence of said background signal in said video output signal enhancing the display of said predetermined video information by increasing the background displayed during each raster scan.

2. The display interface circuit of claim 1, wherein said video source is comprised of:

video RAM means for receiving said predetermined video information and outputting two parallel characters of data; and parallel/serial converting means, responsive to a load signal and a dot clock signal for producing said video signal.

3. The display interface circuit of claim 1, wherein said first signal skewing means is a D-type flip flop device.

4. The display interface circuit of claim 1, wherein said second signal skewing means is a D-type flip flop device.

5. The display interface circuit of claim 1, wherein said first logic circuit means is a two-input NAND device.

6. The display interface circuit of claim 1, wherein said second logic circuit means is a two-input OR device.

7. The display interface circuit of claim 1, wherein said third logic circuit means is a two-input AND device.

8. The display interface circuit of claim 1, wherein said display device is a cathode ray tube.

* * * * *